US011052413B2

(12) United States Patent
Alluigi

(10) Patent No.: US 11,052,413 B2
(45) Date of Patent: Jul. 6, 2021

(54) REMOTE TRIGGER HEAD FOR DISPENSING A LIQUID AND DISPENSING DEVICE

(71) Applicant: GUALA DISPENSING S.p.A., Alessandria (IT)

(72) Inventor: Riccardo Alluigi, Alessandria (IT)

(73) Assignee: GUALA DISPENSING S.p.A., Alessandria (IT)

( * ) Notice: Subject to any disclaimer, the term of this patent is extended or adjusted under 35 U.S.C. 154(b) by 255 days.

(21) Appl. No.: 16/303,939

(22) PCT Filed: May 24, 2016

(86) PCT No.: PCT/IB2016/053036
§ 371 (c)(1),
(2) Date: Nov. 21, 2018

(87) PCT Pub. No.: WO2017/203323
PCT Pub. Date: Nov. 30, 2017

(65) Prior Publication Data

US 2020/0316624 A1 Oct. 8, 2020

(51) Int. Cl.

| | |
|---|---|
| ***B05B 9/04*** | (2006.01) |
| ***B65H 75/42*** | (2006.01) |
| ***B65H 75/44*** | (2006.01) |
| ***B65H 75/48*** | (2006.01) |

(52) U.S. Cl.
CPC ..... *B05B 9/0426* (2013.01); *B65H 75/42* (2013.01); *B65H 75/4431* (2013.01); *B65H 75/48* (2013.01); *B65H 2701/33* (2013.01)

(58) Field of Classification Search
CPC .. B05B 9/0426; B65H 2701/33; B65H 75/42; B65H 75/4431; B65H 75/48
USPC ..... 222/372, 543, 375
See application file for complete search history.

(56) References Cited

U.S. PATENT DOCUMENTS

| | | | | |
|---|---|---|---|---|
| 3,061,202 | A * | 10/1962 | Tyler | B05B 15/30 239/333 |
| 3,638,837 | A * | 2/1972 | Fullerton | G05D 11/00 222/134 |
| 4,187,962 | A * | 2/1980 | Henry | B65H 75/40 137/355.22 |
| 4,543,982 | A * | 10/1985 | Wolfe | B65H 75/40 137/355.21 |
| 4,708,532 | A * | 11/1987 | Leppanen | E04G 21/04 405/303 |
| 5,373,973 | A | 12/1994 | Foster | |
| 5,390,695 | A * | 2/1995 | Howard | B65H 75/38 137/355.16 |

(Continued)

FOREIGN PATENT DOCUMENTS

| | | |
|---|---|---|
| CN | 204847638 U | 12/2015 |
| GB | 2 478 758 A | 9/2011 |

OTHER PUBLICATIONS

International Search Report and Written Opinion of the International Searching Authority for International Patent Application No. PCT/IB2016/053036 dated Feb. 20, 2017, 8 pages.

*Primary Examiner* — Michael J. Melaragno
(74) *Attorney, Agent, or Firm* — Merchant & Gould P.C.

(57) ABSTRACT

A remote trigger head for dispensing a liquid includes a rewindable tube (2) having a predefined length and a winder unit (70) for the automatic spring rewinding of the tube (2).

11 Claims, 10 Drawing Sheets

(56) References Cited

U.S. PATENT DOCUMENTS 5,392,808 A * 2/1995 Pierce ..... B65H 75/38 128/202.27
5,469,993 A * 11/1995 Hauf ..... B05B 9/0426 222/383.3
5,782,412 A * 7/1998 Plantz ..... B65H 75/40 137/355.2
5,860,574 A * 1/1999 Shanklin ..... B05B 1/3026 222/530
6,367,665 B1 4/2002 Barriac et al.
6,409,052 B1 6/2002 Barriac et al.
6,554,319 B2 4/2003 Barriac et al.
6,820,769 B2 11/2004 Foster et al.
7,607,556 B2 10/2009 Engelen
7,819,292 B2 * 10/2010 Arcuri ..... B05B 9/0811 222/383.3
8,408,430 B2 * 4/2013 Dennis ..... B05B 11/3045 222/382
10,188,846 B1 * 1/2019 Priszner ..... B65H 75/4449
2004/0178223 A1 * 9/2004 Foster ..... B05B 9/0426 222/153.13
2005/0194408 A1 * 9/2005 Dodd ..... B05B 9/0426 222/383.1
2006/0255080 A1 * 11/2006 Engelen ..... B05B 9/0426 222/530
2008/0029620 A1 * 2/2008 Hillhouse ..... B05B 11/3095 239/337
2008/0054116 A1 * 3/2008 Han ..... B65H 75/4434 242/385.2
2011/0036924 A1 2/2011 Huang
2013/0161438 A1 * 6/2013 Van Der Paal .... B65H 75/4426 242/390.1
2013/0193232 A1 * 8/2013 Dobias ..... A01M 7/0046 239/308
2014/0027540 A1 * 1/2014 Newton ..... A01C 23/042 239/310
2015/0129682 A1 * 5/2015 Mitchell ..... F16L 37/40 239/154
2015/0231659 A1 * 8/2015 Voelker ..... A01M 7/0046 239/375
2015/0251813 A1 * 9/2015 Voelker ..... B05B 15/62 239/526
2017/0197225 A1 * 7/2017 Zheng ..... B05B 9/0413
2017/0347630 A1 * 12/2017 O'Brien ..... B65H 75/4431
2018/0027775 A1 * 2/2018 Smith ..... B65H 75/4431
2018/0260798 A1 * 9/2018 Bacallao ..... G06K 7/10881
2018/0338474 A1 * 11/2018 Bogdahn ..... B65H 75/406
2019/0255546 A1 * 8/2019 Sokolowski ..... B67D 7/0205

* cited by examiner

REMOTE TRIGGER HEAD FOR DISPENSING A LIQUID AND DISPENSING DEVICE

This application is a National Stage Application of PCT/IB2016/053036, filed 24 May 2016, and which application is incorporated herein by reference. To the extent appropriate, a claim of priority is made to the above-disclosed application.

BACKGROUND OF THE INVENTION

This invention belongs to the field of triggering dispensing devices in which the trigger dispensing head is usable remotely with respect to the container of the liquid to be dispensed. Such devices are usually referred to as "remote trigger dispensers".

Generally, for this type of devices, the head is connected to the container by means of a significantly long flexible tube, so that during use the container can be placed in a fixed location, for example on the ground or on a shelf, while the head is grippable by the operator and used near the object to be sprayed.

For example, such devices are in widespread use in the gardening sector, for spraying fertilisers or other plant care substances.

Many remote trigger device solutions are known.

For example, there are the Mixor® HP Remote device from Saint-Gobain Calmar Inc., the Mixor® Remote device from MeadWestvaco Calmar Inc., the Power sprayer PS2003® Remote device from Saint-Gobain Calmar Inc.

Further solutions are also described in documents U.S. Pat. Nos. 5,469,993, 5,373,973, 6,367,665, 6,409,052, 6,554,319, 6,820,769 and 7,607,556.

However, the solutions of the known art have several drawbacks.

Among others, there is the particularly felt problem of storing the device in proper order after use, especially because of the long tube that connects the head to the container.

The known devices generally provide for forming a coil with the flexible tube, to be placed for example in a compartment provided in the container, or around the handle of the dispensing head.

However, these are not satisfactory solutions; in fact, the tube wrapped around the handle is cumbersome, tends to unwind by itself and often leads to the tearing of the tube itself, if the coils are wound too tightly; when instead a compartment for the tube is provided in the container, the user often has difficulty inserting the coil in this compartment, because its overall dimensions, or he winds the coil tightly, risking tearing the tube.

SUMMARY OF THE INVENTION

The purpose of this invention is to provide a remote trigger dispensing device that overcomes the drawbacks referred to above.

BRIEF DESCRIPTION OF THE DRAWINGS

The characteristics and advantages of the device according to this invention will be apparent from the following description, given by, way of non-limiting example, in accordance with the accompanying figures, in which.

DETAIL DESCRIPTION OF THE PREFERRED EMBODIMENTS

Figure 1:
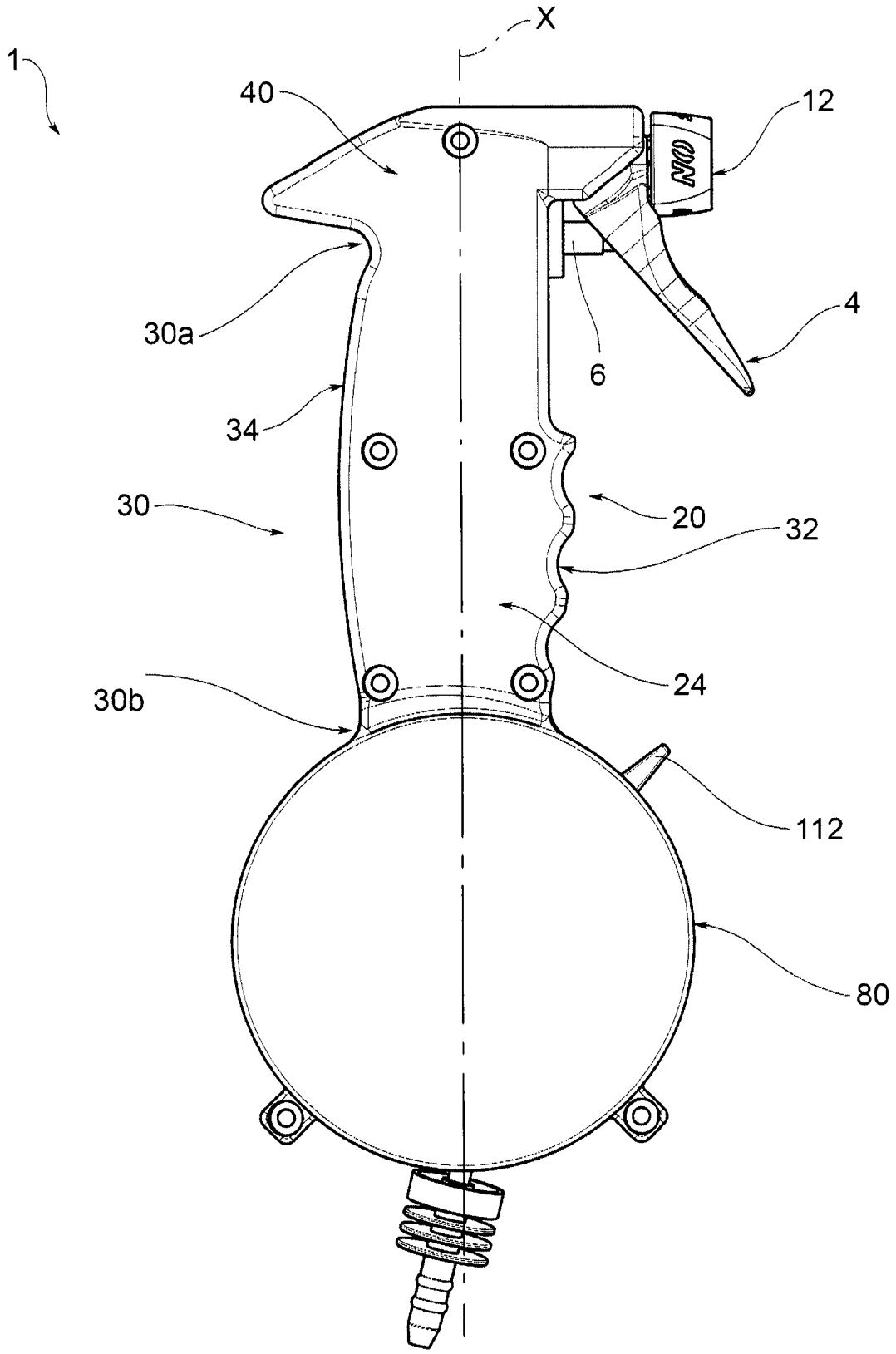
FIG. 1 shows a remote trigger head for dispensing according to an embodiment of this invention.
Figure 2:
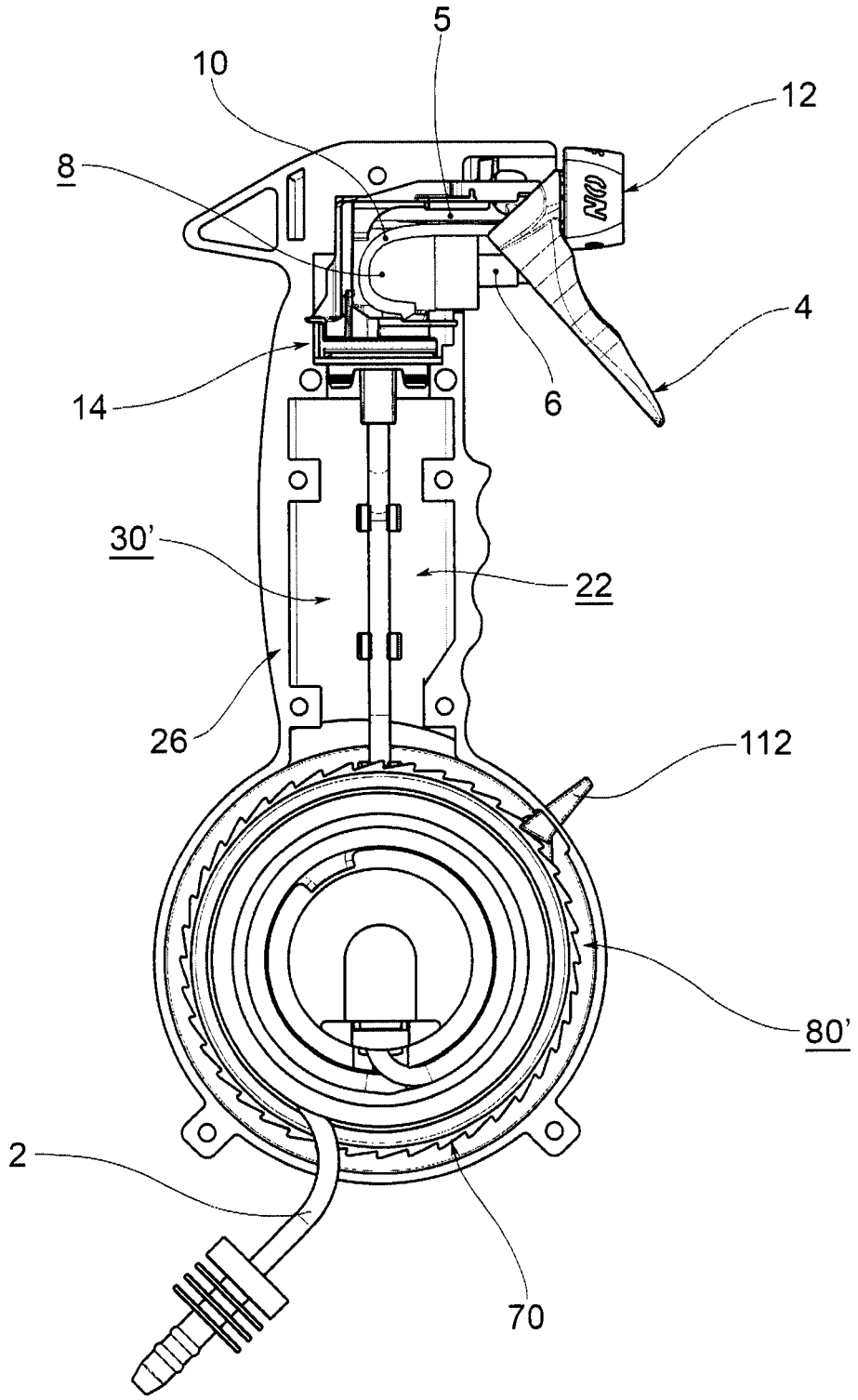
FIG. 2 represents the head of FIG. 1 without first half casing, in a configuration with wound tube.
Figure 3:
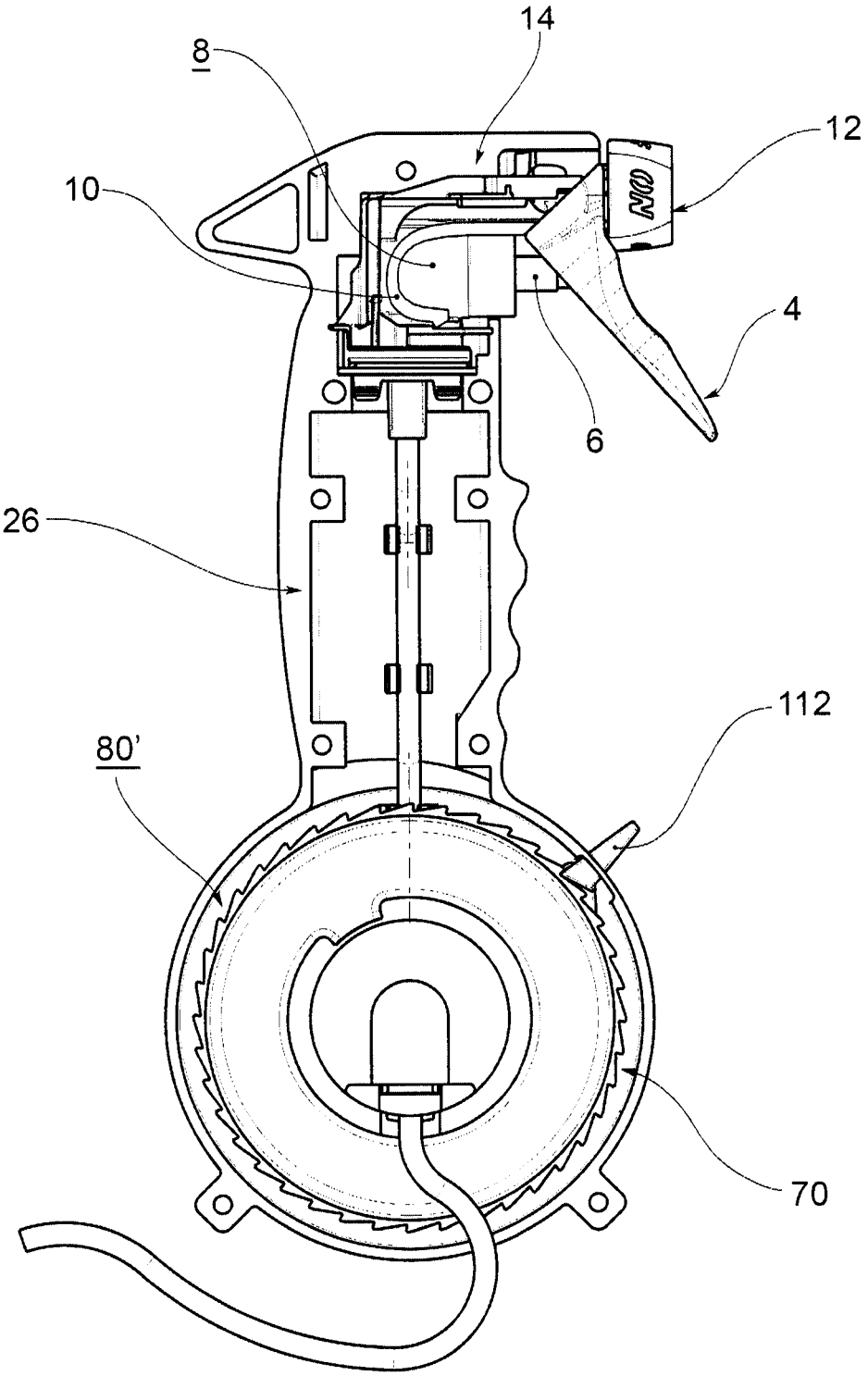
FIG. 3 represents the head of FIG. 2, in a configuration with unwound tube.
Figure 4:
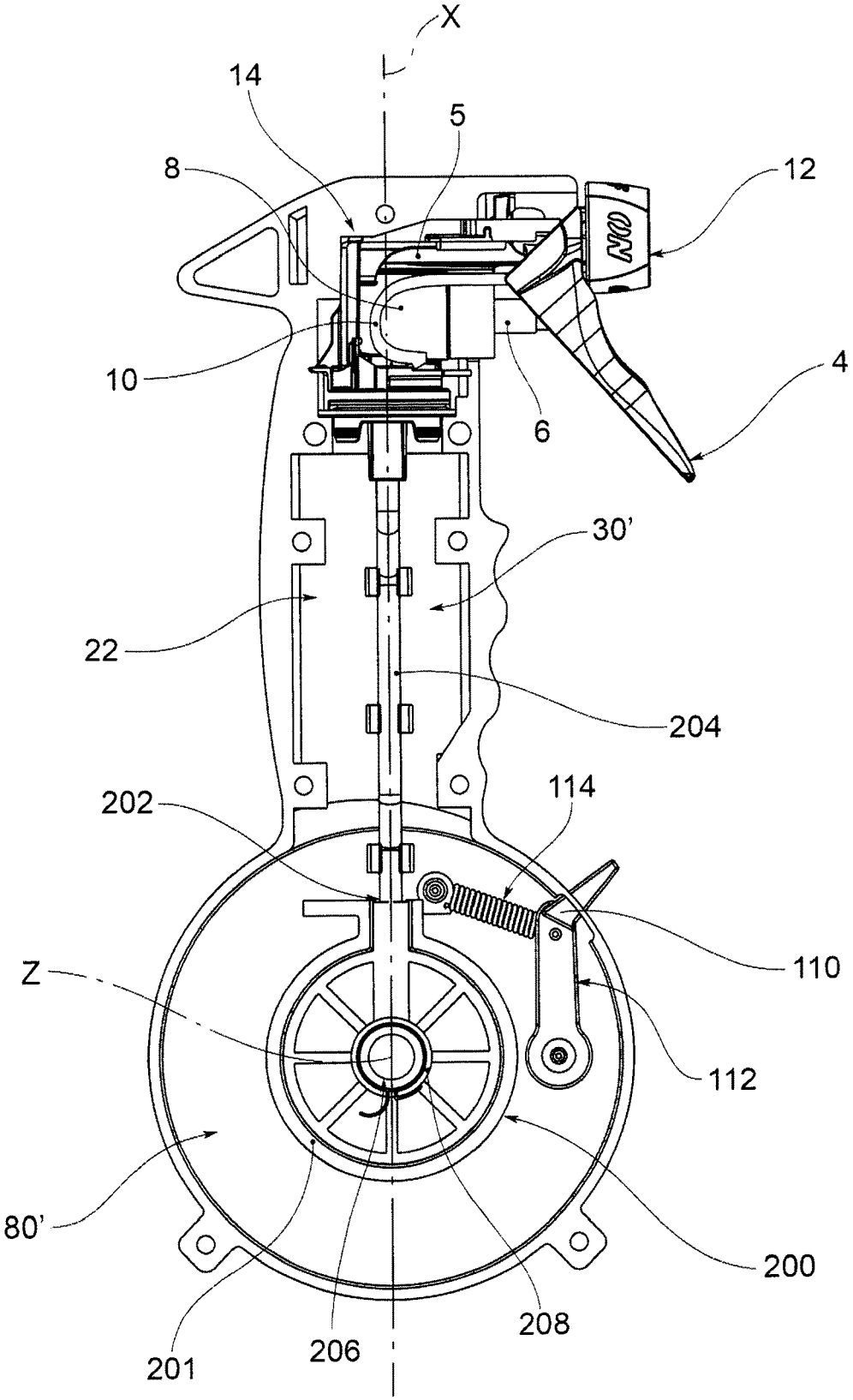
FIG. 4 represents the head of FIG. 2, in a configuration with winder unit.
Figure 5:
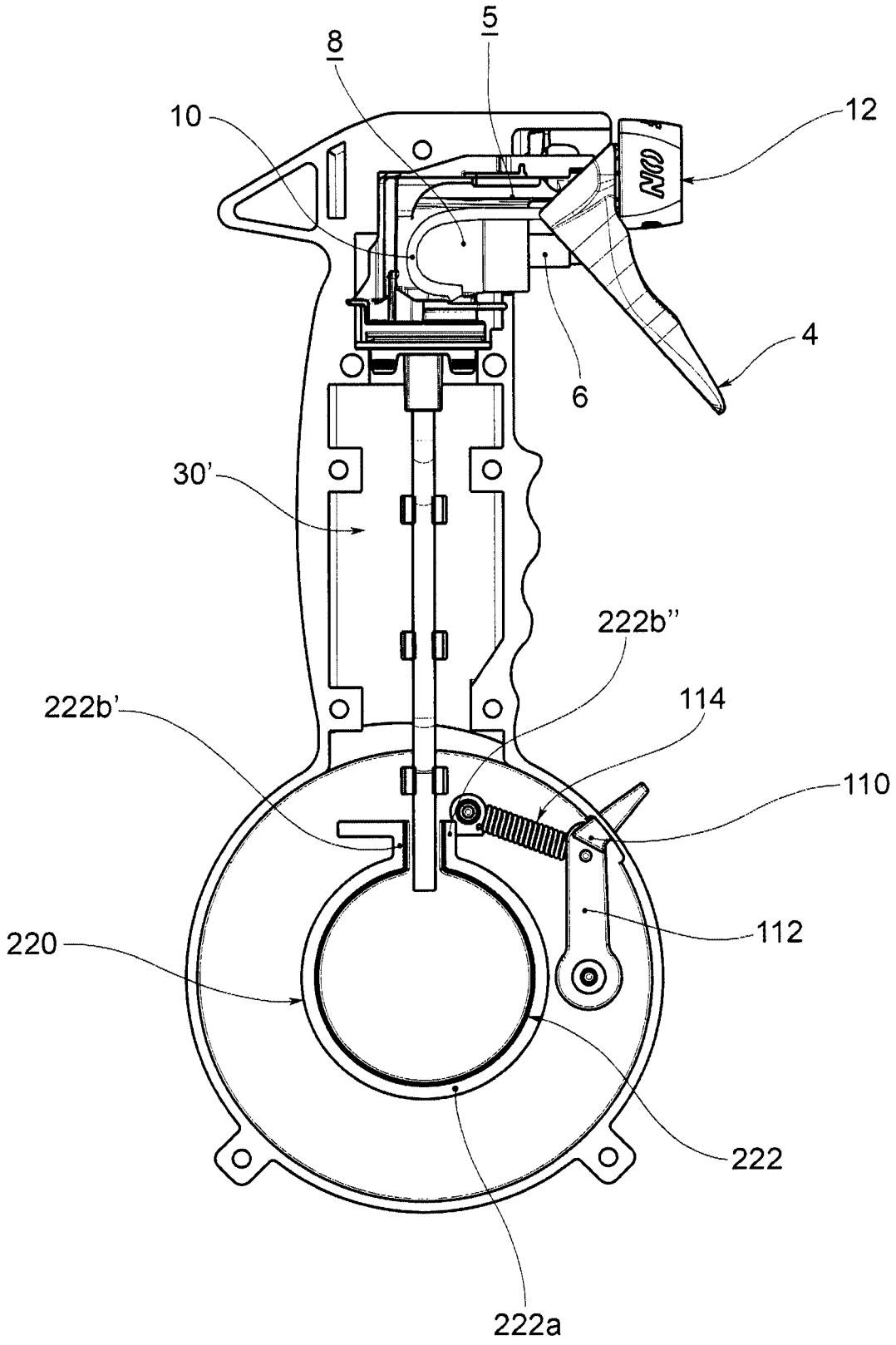
FIG. 5 represents the head of Figure in a configuration without connection unit.

According to the invention, a remote trigger head for dispensing 1 is provided with a significantly long tube 2, for fluidic connection with a container (not shown) in which is contained the liquid to be dispensed.

The head 1 is provided with a trigger 4, a dispensing duct 5, and pumping means connected to the tube 2 and actuatable by the trigger 4 for the aspiration of the liquid through the tube 2 and dispensing to the outside through the dispensing duct 5.

For example, said pumping means comprise a piston 6 actuatable by the trigger 4 for dispensing the liquid, and a pressure chamber 8, in which resides the liquid already aspirated from the container and yet to be dispensed, in which the piston 6 for dispensing the liquid operates between a rest position (trigger released) and a dispensing limit position.

For example, the piston 6 is sealingly slidable in the pressure chamber 8 under the action of the trigger 4.

The pumping means also comprise elastic return means operating permanently on the trigger 4 or/and on the piston 6 towards the rest position.

For example, said elastic return means comprise a spring 10, for example engaged with the trigger 4, in turn linked with the piston 6, and with a fixed abutment.

Preferably, said pumping means comprise valvular means of aspiration operating upstream of the pressure chamber 8, suitable to allow the aspiration of the liquid through the tube 2 during an aspiration step and suitable to prevent the return of the liquid contained in the pressure chamber 8 towards the tube 2 during a dispensing step.

Preferably, in addition, said pumping means comprise valvular dispensing means operating downstream of the pressure chamber 8, suitable to allow the dispensing of the liquid contained in the pressure chamber 8 towards the dispensing duct 5 during the dispensing step and suitable to prevent the return of the liquid from the dispensing duct 5 towards the pressure chamber 8 during the aspiration step.

Preferably, in addition, said valvular dispensing means are valvular pre-compression means, suitable to allow the dispensing of the liquid contained in the pressure chamber 8 towards the dispensing duct 5 when, during the dispensing step, the pressure in the pressure chamber 8 exceed a predefined threshold value.

Preferably, moreover, the head 1 comprises a nozzle 12, placed at the outlet of the dispensing duct 5, to close said dispensing duct and/or select a dispensing type, for example with spray formed from more or less fine droplets, with a range more or less long or with an opening angle more or less wide.

Preferably, the head 1 comprises a frame 14 for the support of one or more of the aforesaid components.

For example, the pressure chamber 8 is realised in said frame 14, the dispensing duct 5 is realised in said frame 14, the trigger 4 is engaged, for example hinged, with the frame 14 and the fixed abutment for the spring 10 is constituted by said frame 14.

According to a preferred embodiment, the frame 14, the pumping means, the delivery duct 5, the trigger 4 and the nozzle 12 constitute a distinct dispensing unit 18.

In addition, according to a preferred embodiment, the head 1 comprises an outer casing 20 for gripping said head 1, which defines an inner compartment 22 for housing the components.

For example, the casing 20 comprises a first half-casing 24 and a second half-casing 26, coupleable to delimit the inner compartment 22 and separable for access to said inner compartment 22.

The casing 20 comprises a handle portion 30 suitable to be gripped by a user; said handle portion 30 preferably extends along a rectilinear main axis X between an upper end 30*a* and a lower end 30*b*.

Preferably, the handle portion 30 is defined at the front, i.e., on the side on which is disposed the trigger 4, by a wavy surface 32 for the placement of the fingers according to an ergonomic grip. Posteriorly, preferably, said handle portion 30 is defined by an arcuate surface 34 for supporting the palm of the hand.

The casing 20 also includes a functional portion 40, joined to the handle portion 30 at the upper end 30*a* of this.

The dispensing unit 18 is applicable to the functional portion 40 of the casing 20.

Figure 6:
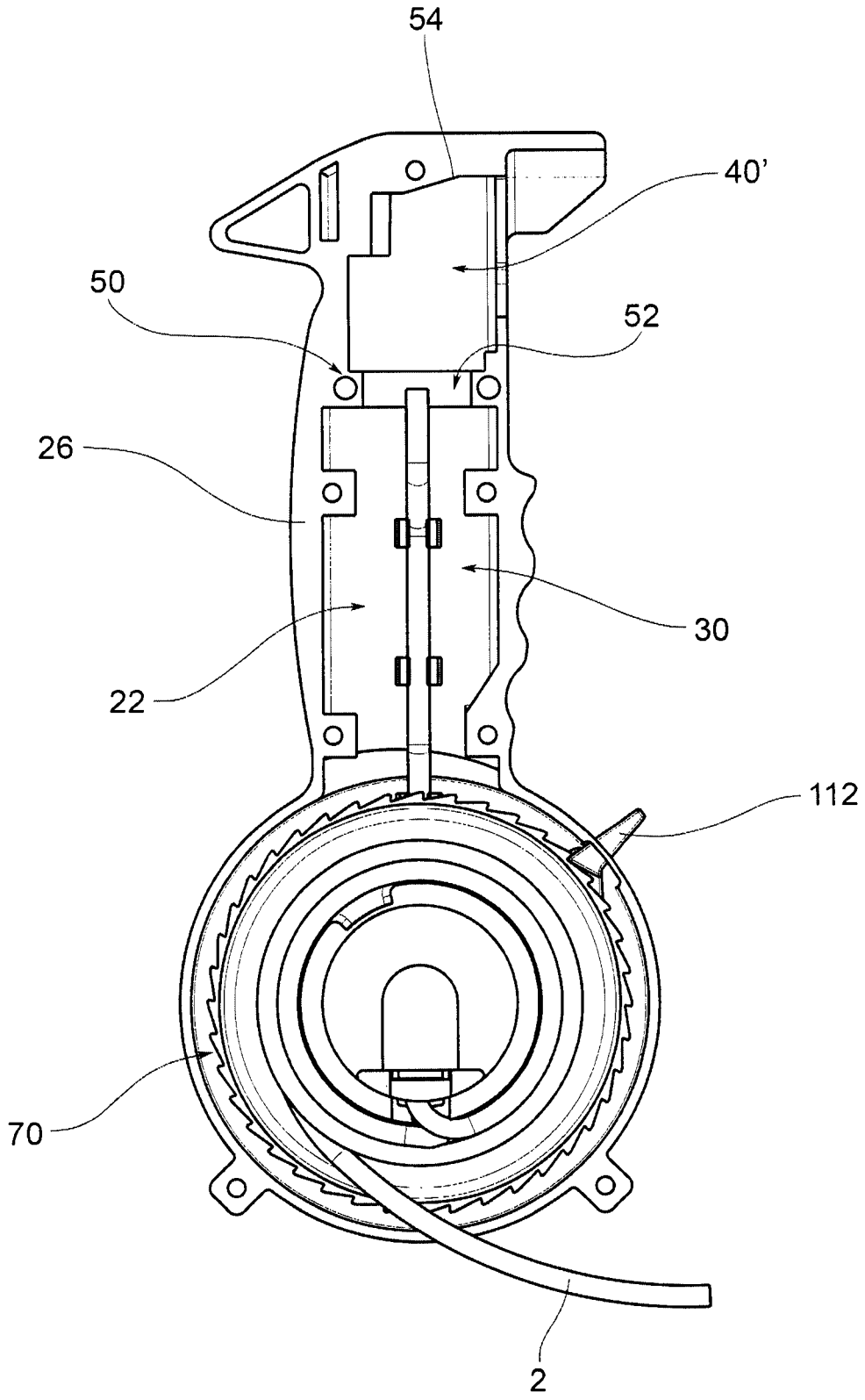
FIG. 6 illustrates the head of FIG. 2, without a dispensing unit.
Figure 7:
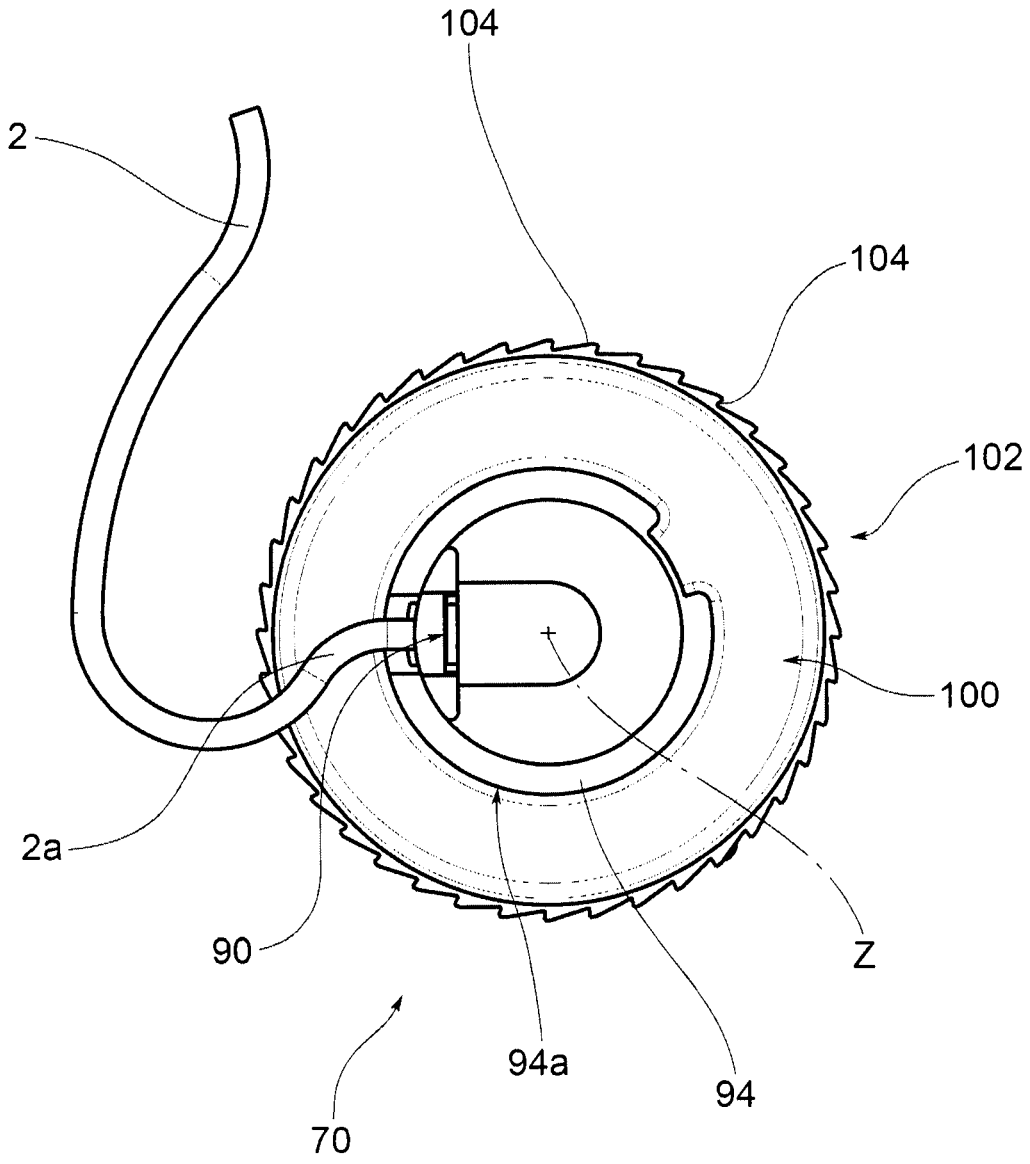
FIG. 7 illustrates the winder unit according to a front view.
Figure 8:
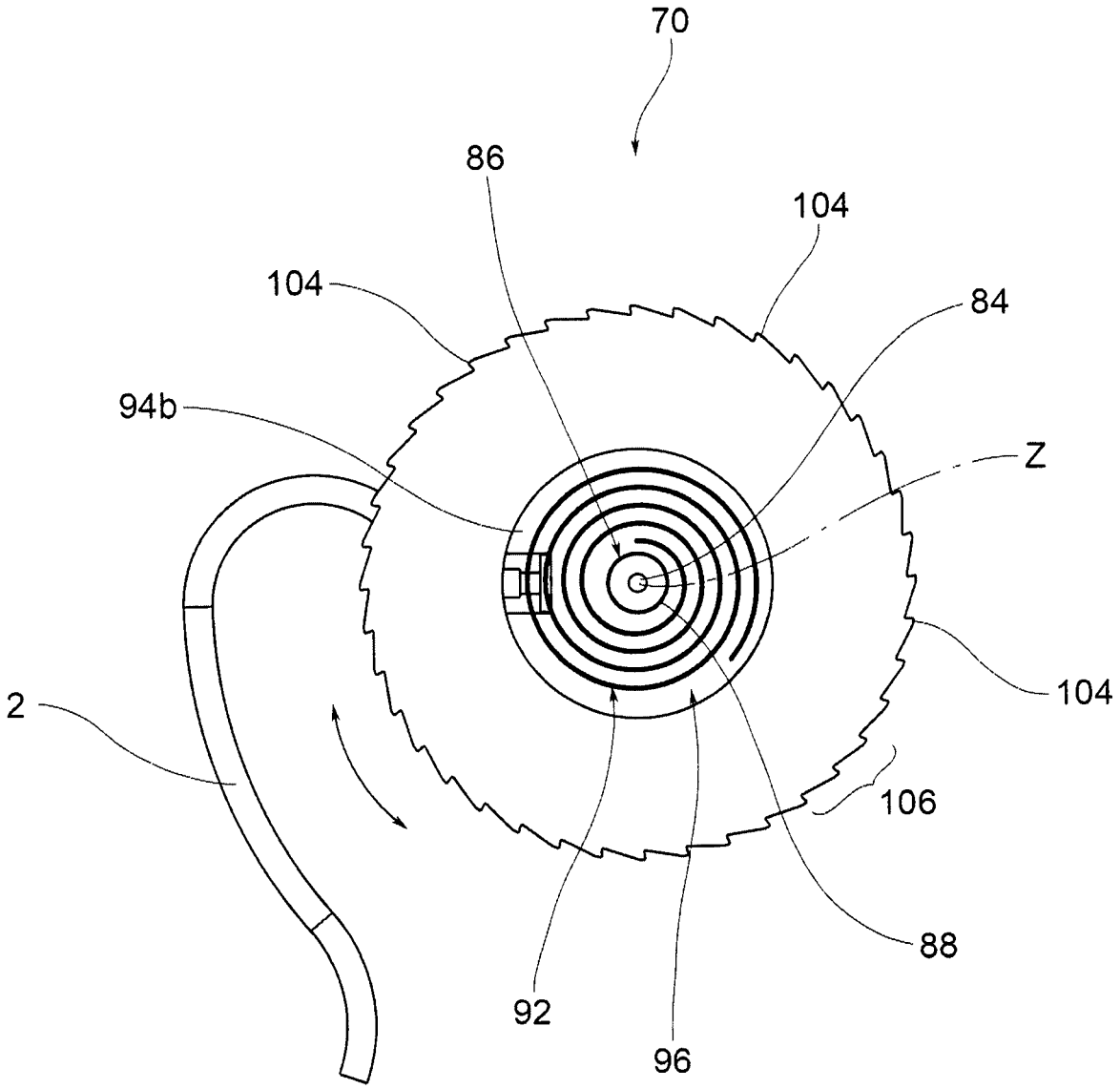
FIG. 8 illustrates the winder unit according to a rear view.
Figure 9:
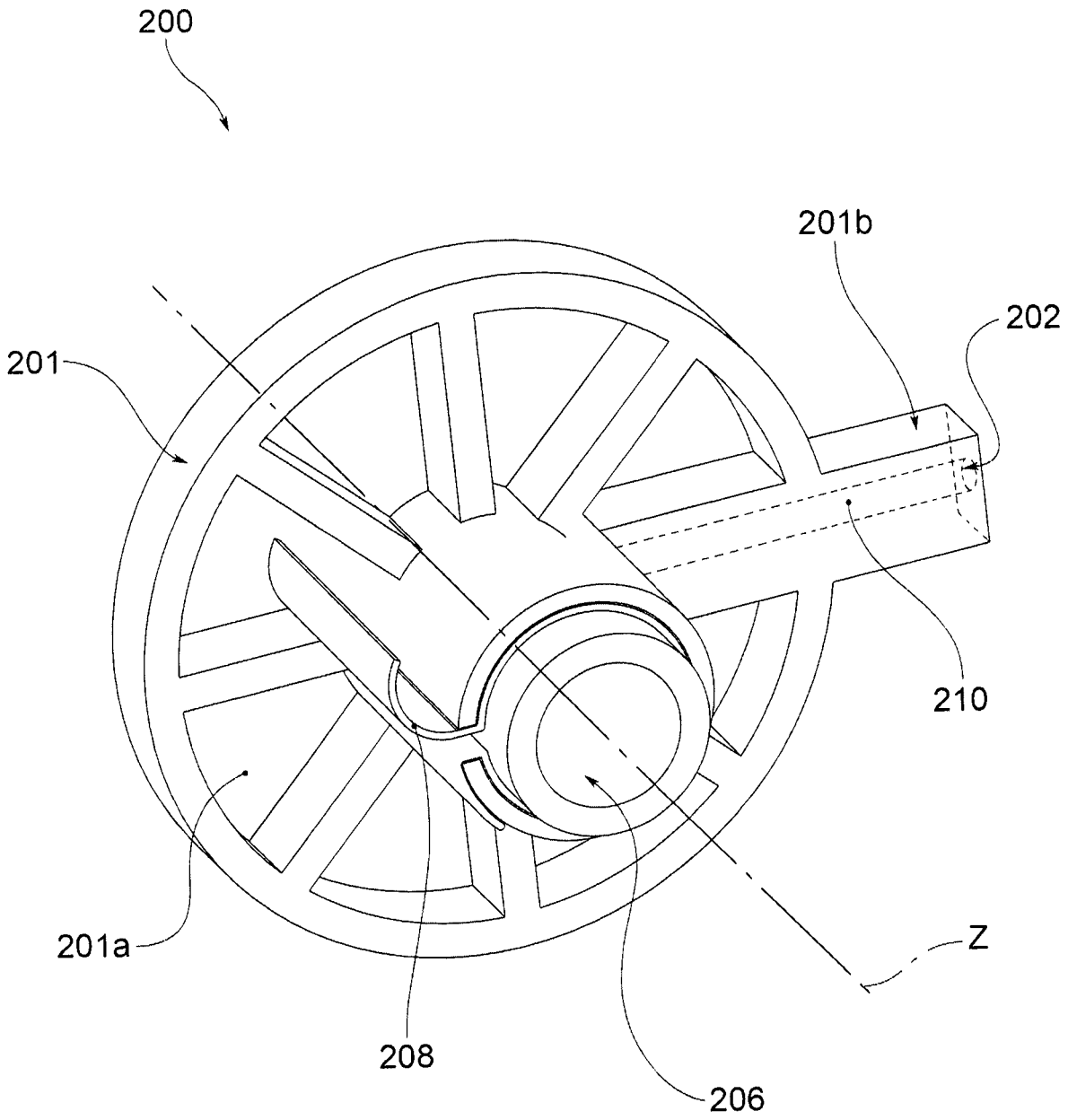
FIG. 9 shows the connection unit.

In particular, in the inner compartment 22 of the casing 20, there is distinguished a functional compartment 40' in correspondence of the functional portion 40 and a handle compartment 30 in correspondence of the handle portion 30 (FIG. 6).

The dispensing unit 18 is at least partially houseable in the functional compartment 40', so that the trigger 4 and the nozzle 12 project outwards. In other words, in said compartment 40' are housed the frame 14, engaged with the trigger 4, with the spring 10 and with the nozzle 12.

Preferably, the functional compartment 40' is delimited towards the handle compartment 30' by an annular support 50 of the casing 20, provided with a through opening 52, so that the functional compartment 40' is in communication with the handle compartment 30'.

On the side axially opposite to the annular support 50, the functional compartment 40' is bounded by an abutment wall 54 of the casing 20, suitably shaped.

The dispensing unit 18 is thus located in the functional compartment 40', resting on one side on the annular support 50 and the other in contact with the abutment wall 54, to remain firmly in position.

Figure 10:
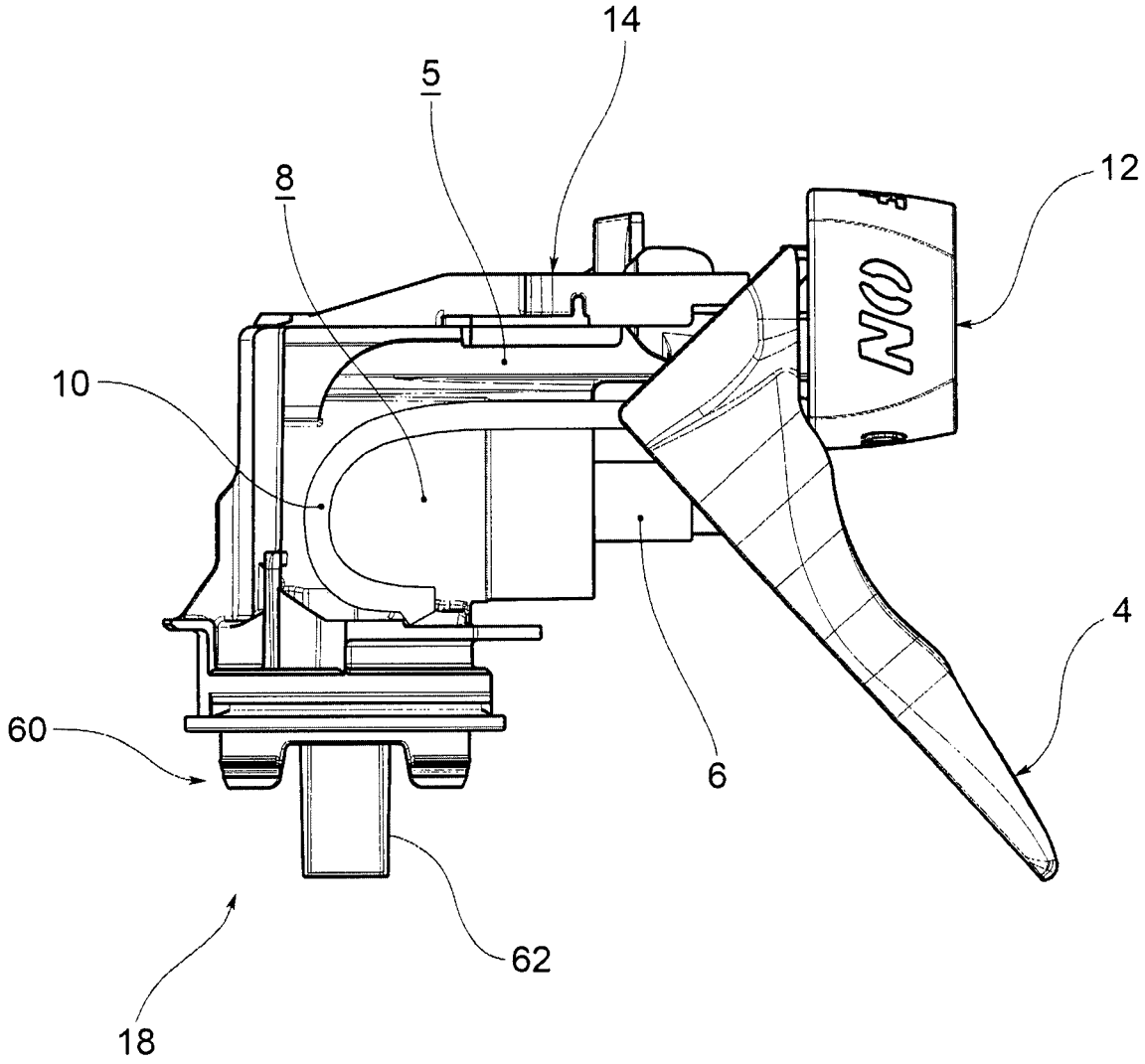
FIG. 10 shows the dispensing unit.

Preferably, the dispensing unit 18 includes a connector 60 (FIG. 10), to which is applied the frame 14, provided with a connection mouth 62 for fluidic connection with the tube 2.

Preferably, the connector 60 engages by shape-coupling with the annular support 50 of the casing.

The head 1 according to the invention is provided with a winder unit 70 (FIGS. 2, 3 and 7, 8) for the automatic rewinding of the tube 2.

In other words, the winder unit 70 is a spring device that automatically, when the tube 2 is brought into an unlocked configuration and released, is suitable to automatically rewind it by means of a spring mechanism.

Preferably, the winder unit 70 is housed in the casing 20 of the head 1.

For this purpose, the casing 20 comprises a winder unit portion 80, joined to the handle portion 30 in the lower end 30*b*, i.e., on the side opposite the functional portion 40.

The winder unit 70 is housed in the winder unit portion 80.

In particular, the inner compartment 22 of the casing 20 has a winder unit compartment 80' corresponding to the winder unit portion 80 of the casing 20; the winder unit 70 is housed in the winder unit compartment 80'.

Preferably, the winder unit compartment 80' is in communication with the handle compartment 30' and/or with the functional compartment 40'.

The winder unit 70 comprises a winder body 82, rotatable about a winding axis Z, provided with an outlet mouth 84 placed in axis with the winding axis Z, destined to the output of the liquid towards the dispensing unit 18.

For example, the outlet mouth 84 is placed at the end of an outlet shank 86 that extends along said winding axis Z.

Preferably, the outlet shank 86 externally has a sealing seat, in which is housed a sealing ring 88.

The winder body 82 also comprises an inlet mouth 90, in communication with the outlet mouth 84, for example placed on the side opposite to this along the winding axis Z.

The inlet mouth 90 is intended for connection with a first end 2*a* of the tube 2.

The winder unit 70 also comprises an elastic element 92, for example a spiral spring, preferably metallic, placed between the winder body 82 and a fixed abutment to permanently induce said winder body 82 to rotate in a predefined winding direction. For example, the elastic element 92 is wound around the outlet shank 86.

Preferably, the winder 82 comprises an inner wall 94 substantially cylindrical and with a central axis coincident with the winding axis Z.

The inlet mouth 90 is located inside of the inner wall 94, while the first end 2*a* of the tube 2, connected to said inlet mouth 90, passes through said inner wall 94, so that during the winding of the tube 2, said tube is wound in coils, even irregular, on an outer lateral surface 94*a* of said inner wall 94.

The output shank 86 is arranged inside the inner wall 94 and the interspace between said output shank 86 and an inner lateral surface 94*b* of the inner wall 94 form a spring compartment 96 in which is housed the elastic element 92.

Preferably, also, the winder unit 70 comprises a locking mechanism suitable to block the rotation of the winder body 82 in the winding direction of rotation, which can be manually disabled to permit said winding rotation. In particular, said locking mechanism is a one-way ratchet.

According to a preferred embodiment, the locking mechanism comprises a locking wheel 100 of the winder body 70, integral with the inner wall 94, for example concentric to this and such as to extend radially externally to said inner wall 94.

Along a circumferential peripheral edge 102, said locking wheel 100 has a plurality of teeth 104 in succession, which form a snap-locking profile 106.

In addition, the locking mechanism comprises a locking element 110 suitable to cooperate with the locking profile 106 to block the rotation of the winder body 82 in the winding direction of rotation, while allowing the rotation of the winder body 82 in the opposite direction (toward the unwinding direction of rotation).

The locking mechanism further comprises an unlocking lever 112, integral to the unlocking element 110, and an elastic locking element 114, which operates permanently on the unlocking lever 112 in the direction of bringing the locking element 110 into engagement with the locking profile 106.

The locking mechanism is housed in the winder unit compartment 80', while the unlocking lever 112, hinged inside the winder unit compartment 80', projects at least partly outwards, in order to be actuated for unlocking.

In a locking configuration, in which the locking mechanism is activated, the elastic element 114 influences the unlocking lever 112, so that the locking element 110 is in engagement with the locking profile 106 of the locking wheel 100.

In such configuration, the rotation of the winder body 82 in the unwinding direction of rotation of the tube 2 is allowed, because the locking element 110 snaps from one tooth 104 to the next. On the contrary, the rotation in the winding direction of the tube 2 is prevented by the contrast exercised by the locking element 110 on the tooth 104 engaged.

When the tube 2 is completely or partially unwound, the elastic element 92 of the winder unit 70 exerts on the winder body 82 an action that tends to make said winder body 82 rotate in the winding direction of rotation, to automatically rewind the tube 2. However, if the unlocking mechanism is activated, i.e., in the aforesaid locking configuration, said rotation is prevented.

If the locking mechanism is manually deactivated, for example by operating on the unlocking lever 112, the locking element 110 frees the locking wheel 100 and the winder body 82 automatically produces a rotation in the winding direction of the tube 2, under the action of the elastic element 92.

Preferably, moreover, the head 1 comprises a connection unit 200 fixed with respect to the rotatable winder body 82, for example, mounted fixed to the casing 20, in the winder unit compartment 80'.

The connection unit 200 acts as a curved junction, i.e., it allows diverting an incoming flow of liquid in the direction of the winding axis Z in an outgoing flow of liquid in the direction of the main axis X of the handle portion 30.

For example, the connection unit 200 comprises a connection body 201 that provides a sending mouth 202 intended to be fluidically connected with the pressure chamber 8 of the dispensing unit 18.

For example, the head 1 comprises an auxiliary tube 204. Connected at one end to the sending mouth 202 and at the other end to the dispensing unit 18, in particular to the connector 60, through the handle compartment 30'.

The connection body 201 further provides an attachment 206, in fluidic connection with the sending mouth 202, for fluidic connection with the outlet mouth 84 of the winder body 82.

For example, the attachment 206 is constituted by an attachment shank 208 that extends along the winding axis Z, sealingly engageable with the outlet mouth 82 of the winder body 82; for example, the output shank 86 of the winder body 82 is sealingly insertable in the attachment shank 208, so as to be rotatable about the winding axis Z.

The sending mouth 202 is instead realised at the end of a sending duct 210 realised in the connection body 201.

According to an embodiment variant, the connection body 201 is constituted by a circular portion 201*a*, from which projects the attachment shank 208, and a radial projection 201*b* projecting radially from the circular portion 201*a*, in which is formed in the sending duct 210.

Definitively, the connection body 201 has a non-cylindrical peripheral profile, so as to realise with the casing 20 with a shape-coupling that prevents rotation around the winding axis Z.

For example, in the winder unit compartment 80' there is provided a connection seat 220, delimited by a contour wall 222 that negatively resumes the trend of the peripheral profile of the connection body 201.

In this way, the connection body 201 is insertable in the seat of the connection body 220 but, but once inserted, it is locked in rotation.

For example, the contour wall 222 includes an interrupted circular portion 222*a*, which resumes the peripheral profile of the circular portion 201*a* of the connection body 201, and a pair of constraint sections 222*b*',222*b*", projecting from the interruption of the circular portion 222*a* and spaced apart, between which is received the radial projection 201*b* of the connection body 201.

The contour wall 222 thus forms an anti-rotation constraint for the connection body 200.

In the normal operation of the head 1, starting from an initial winding configuration in which the tube 2 is completely wound, it is possible to unwind the tube by pulling it.

This causes the rotation of the winder body 82 in the unwinding direction of rotation, which is not prevented by the locking mechanism.

When the free end of the tube 2 is applied to a container, it is possible to use the head 1.

The activation and repeated release of the trigger 4, cause the aspiration of the liquid from the container and its dispensing from the nozzle 12.

In particular, the release of the trigger causes the aspiration of the liquid through the tube 2, the entry of the liquid into the winder body through the inlet mouth 90, the exit of the liquid from the winder body through the outlet mouth 84 along the direction of the winding axis Z, the entry of the liquid 200 into the connection body 200 fixed through the attachment 206 along the direction of the winding axis Z, the exit of the liquid through the sending mouth 202 in the direction of the main axis X and finally the arrival of the liquid in the pressure chamber 8 of the dispensing unit 18.

The activation of the trigger 4, then causes the action of the piston 6 in the pressure chamber 8 and thus the sending of the liquid to the dispensing duct 5 and dispensing through the nozzle 12.

When the use of the device is ended and the tube 2 is disconnected from the container, said tube remains unwound because the locking mechanism prevents undesired rewinding.

By operating on the unlocking lever 112, the locking mechanism releases the winder body 82, which performs an automatic rotation in the winding direction of rotation, automatically rewinding the tube, for example inside the casing 20.

Innovatively, the remote trigger head for dispensing according to this invention overcomes the drawbacks mentioned above with reference to the known art.

In fact, the automatic rewinding of the tube allows obtaining its minimum dimensions and thus properly storing it in the head after use.

In addition, advantageously, the tube is wound forming coils that are not too tight, avoiding damaging the hose.

According to a further advantageous aspect, the realisation of the head is particularly simple and fast, since it is possible to separately realise the dispensing unit, the winder unit with the locking mechanism and the connection unit, and then mount them inside the casing.

It is clear that one skilled in the art, in order to meet contingent needs, may make changes to the head described above.

For example, according to an embodiment variant, the winder unit is separated from the casing and connected to the dispensing unit by means of an additional tube of significant length.

According to a further embodiment variant, the winder unit is on board the casing, but arranged outside it.

According to a still further embodiment variant, the tube, once wound, is arranged outside the casing, for example around a shaft projecting externally from it.

Further, according to an embodiment variant, the winder unit is placed on board the container and the trigger head is applied to said winder unit.

In said embodiment variant, the winder unit 80 of the casing 20 is integrated, for example, with the container.

Even these modifications are contained within the scope of protection, as defined by the following claims.

The invention claimed is:

1. A remote trigger head for dispensing a liquid, comprising:

a rewindable tube having a predefined length and a winder unit for automatic spring rewinding of the tube;

a casing having a handle portion for gripping by a user, the handle portion extending along a main axis, the winder unit being housed in the casing.

2. The trigger head according to claim 1, comprising a casing having a handle portion for gripping by a user, the tube, in a wound configuration, being housed in the casing.

3. The trigger head according to claim 1, wherein the casing has an inner compartment having a handle compartment, corresponding to the handle portion, and a winder unit compartment separate from the handle compartment and in communication with the handle compartment, the winder unit being housed in the winder unit compartment.

4. The trigger head according to claim 3, comprising a dispensing unit provided with the trigger, configured to aspirate the liquid through the tube and to dispense the liquid to the outside, wherein the inner compartment also has a functional compartment separate from the handle compartment, on the side opposite the winder unit compartment, in which the dispensing unit is housed at least partially.

5. The trigger head according to claim 3, wherein the winder unit comprises:

a winder body rotatable about a winding axis, provided with an outlet mouth aligned with the winding axis, and an inlet mouth, in communication with the outlet mouth, connected to a first end of the tube;

an elastic element placed between the winder body and a fixed abutment to permanently induce the winder body to rotate in a predefined winding direction of rotation.

6. The trigger head according to claim 5, comprising a locking mechanism configured to block the rotation of the winder body in the winding direction of rotation, the locking mechanism is configured for manual disabling to permit the winding rotation.

7. The trigger head according to claim 6, wherein the locking mechanism is a one-way ratchet.

8. The trigger head according to claim 6, wherein the locking mechanism comprises a locking wheel of the winder body provided along a circumferential peripheral edge, a plurality of teeth in succession, which form a snap-locking profile.

9. The trigger head according to claim 5, comprising a connection unit fixed with respect to the rotatable winder body, acting as a curved junction to divert an incoming flow of liquid in a direction of the winding axis in an outgoing flow of liquid in a direction of the main axis of the handle portion of the casing.

10. The trigger head according to claim 9, wherein the connection unit comprises a connection body on which the winder body is rotatably mounted, wherein the connection body provides an attachment comprising an attachment shank extending along the winding axis, sealingly engageable with the outlet mouth of the winder body.

11. The trigger head according to claim 10, wherein the winder unit compartment has a connection body seat in which the connection body is inserted to block the rotation of the connection body about the winding axis.

* * * * *